US006253696B1

(12) United States Patent
Mashiko

(10) Patent No.: US 6,253,696 B1
(45) Date of Patent: Jul. 3, 2001

(54) MARINE ENGINE FOR SMALL WATERCRAFT

(75) Inventor: Tetsuya Mashiko, Shizuoka (JP)

(73) Assignee: Yamaha Hatsudoki Kabushiki Kaisha (JP)

( * ) Notice: Subject to any disclaimer, the term of this patent is extended or adjusted under 35 U.S.C. 154(b) by 0 days.

(21) Appl. No.: 09/451,365

(22) Filed: Nov. 30, 1999

(30) Foreign Application Priority Data

Nov. 30, 1998 (JP) ..... 10-339861

(51) Int. Cl.[7] ..... B63B 35/00
(52) U.S. Cl. ..... 114/55.5; 440/89
(58) Field of Search ..... 114/55.5; 440/38, 440/88, 89; 123/198 R, 193.1, 193.2

(56) References Cited

U.S. PATENT DOCUMENTS 4,068,645 * 1/1978 Jenkinson ..... 123/193 C
5,168,838 * 12/1992 Seike et al. ..... 123/52 MV
5,524,596 * 6/1996 Nakai et al. ..... 123/583
5,632,660 5/1997 Nakase et al. .

* cited by examiner

*Primary Examiner*—Ed Swinehart
(74) *Attorney, Agent, or Firm*—Knobbe, Martens, Olson & Bear, LLP

(57) ABSTRACT

The present invention comprises an engine for a watercraft that includes a plurality of separate cylinder bodies. A stay is provided that is supported by at least two of the separate cylinder bodies. The stay supports a portion of the exhaust system. Because the load is shared by the two separate cylinder bodies, the weight of the supported portion of the exhaust system is shared by the two cylinder bodies to inhibit flexion or twisting of the cylinder bodies.

25 Claims, 5 Drawing Sheets

MARINE ENGINE FOR SMALL WATERCRAFT

PRIORITY INFORMATION

This application is based on and claims priority to Japanese Patent Application No. 10-339861, filed Nov. 30, 1998, the entire, contents of which is hereby expressly incorporated by reference.

BACKGROUND OF THE INVENTION

1. Field of the Invention

The present invention relates in general to an engine for a watercraft, and more particularly to mount for mounting engine components to an engine with separate cylinder bodies.

2. Description of Related Art

Personal watercraft have become popular in recent years. This type of watercraft is sporty in nature; it turns swiftly, is easily maneuverable, and accelerates quickly. Personal watercraft today commonly carry one driver and one or two passengers and include a hull which defines an interior engine compartment for housing an engine. The output shaft of the engine is coupled to a water propulsion device of the watercraft, such as a jet propulsion unit. An internal combustion engine is commonly used to power the personal watercraft. Typically, the engine is an in-line, multi-cylinder, two-cycle engine.

The engine includes a cylinder block that defines one or more cylinder bores. The number of cylinder bores corresponds to the desired number of cylinders. The cylinder bores are often lined with steel by pressing a steel sleeves into each cylinder bore. The cylinder bore and steel sleeve together define a cylinder in which a piston reciprocates.

Instead of using steel sleeves to line the cylinder bore, engine manufacturers have recently begun to plate the cylinder bores with a suitable material such as a Nickel alloy. However, engine manufacturers have found it difficult to simultaneously plate multiple cylinder bores when multiple cylinder bores are formed in a single cylinder block. In contrast, it is much easier to plate a single cylinder bore that is contained within it's own separate body. Engine manufacturers have therefore created engines with separate cylinder bodies for each cylinder bore in order to ease the manufacturing process.

Using separate cylinder bodies in an engine has additional advantages over conventional engine blocks. For example, because cylinder bodies are modular and can be combined to form one, two, three or four cylinder engines, they can be mass produced.

There are, however, disadvantages associated with using separate cylinder bodies. For example, in traditional engines the engine block provided a convenient secure place to mount heavy engine components. In comparison, mounting heavy engine components onto separate cylinder bodies can cause uneven loading of a cylinder body with respect to the other cylinder bodies. This uneven loading can cause a cylinder body to twist with respect to the other cylinder bodies and the crankshaft thereby causing damage to other engine components such as the pistons, the crankshaft, and crankcase.

SUMMARY OF THE INVENTION

An aspect of the present invention involves an engine comprising at least two separate cylinder bodies. The cylinder bodies are disposed adjacent to each other, and each cylinder body defines a cylinder bore. The engine also includes a number of pistons equal to the number of cylinder bodies. Each piston is sliceable supported within one of the cylinder bores. A rotational output shaft is coupled to the pistons such that axial reciprocal movement of the pistons within the cylinder bores rotates the output shaft. An exhaust system communicates with the cylinder bores to discharge exhaust gases from the engine. A stay is supported by and extends between the two adjacent cylinder bodies. The stay is arranged to support a component of the engine. Because the load is shared by the two separate and adjacent cylinder bodies, the weight of the supported engine components is shared by the cylinder bodies to inhibit flexion or twisting of the cylinder bodies about the output shaft axis. That is, the resulting structure between the stay and the cylinder bodies provides rigidity to the engine in the direction of the output shaft axis.

In one mode, the engine is disposed within an engine compartment of a small watercraft. The output shaft of the engine is arranged to drive a propulsion device of the watercraft to propel the watercraft. In a further variation, the stay supports a portion of the exhaust system, and preferably an exhaust chamber that houses a catalyst device. Thus, this heavy component of the exhaust system is supported by two separate cylinder bodies for the above-noted purpose.

Further aspects, features, and advantages of the present invention will become apparent from the detailed description of the preferred embodiment that follows.

BRIEF DESCRIPTION OF THE DRAWINGS

The above-mentioned and other features of the invention will now be described with reference to the drawings of a preferred embodiment of the present exhaust system for a watercraft. The illustrated embodiment is intended to illustrate, but not to limit the invention. The drawings contain the following figures.

DETAILED DESCRIPTION OF A PREFERRED EMBODIMENT OF THE INVENTION

The present engine and mount for attaching components to the engine have particular utility for use with a personal watercraft, and thus, the following describes the present invention in the context of a personal watercraft. This environment of use, however, is merely exemplary. The present engine and mount for attaching components to the engine can be readily adapted by those skilled in the art for use with other types of watercraft as well, such as, for example, but without limitation, small jet boats and the like, as well as for use in other vehicles and applications.

An exemplary personal watercraft 10 will be described in detail, in combination with the engine, to assist the reader's understanding of the engine and the mount for attaching engine components to the engine as described herein. The watercraft 10 is suited for movement through a body of water toward a front end or bow of the watercraft 10.

Figure 1:
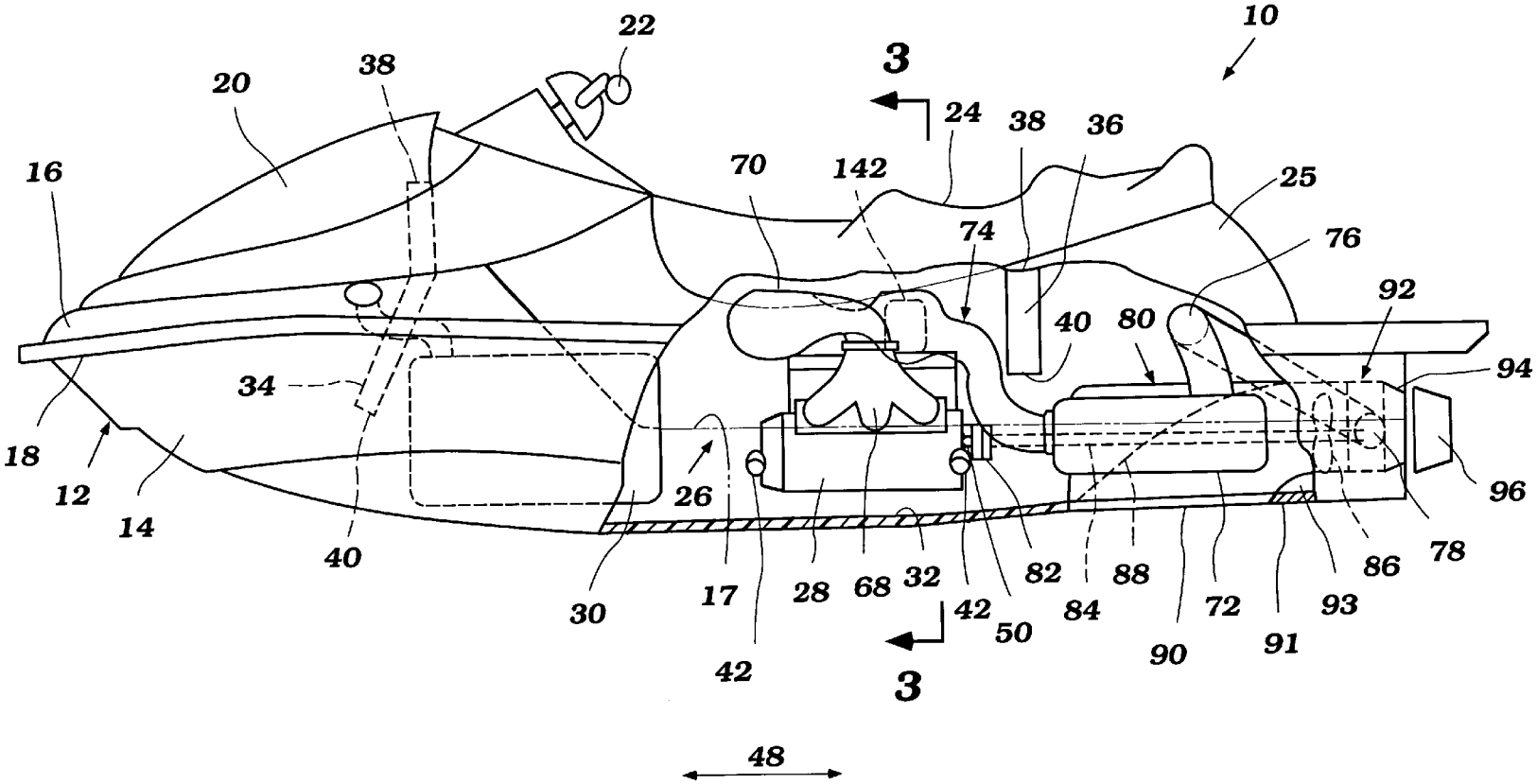
FIG. 1 is a side elevational view of an embodiment of the present invention showing a watercraft partially sectioned to illustrate an interior engine compartment that houses an exhaust system and an engine configured and arranged in accordance with the present invention.

As illustrated in FIG. 1, the watercraft 10 includes a hull 12 formed by a lower section 14 and an upper deck section 16. The hull sections 14, 16 are formed from a suitable material such as, for example, a molded fiberglass-reinforced resin or Sheet Molding Compound (SMC). The lower hull section 14 and the upper deck section 16 are fixed to each other around the peripheral edges 18 in any suitable manner.

As viewed in the direction from the bow to the stem of the watercraft 10, the upper deck section 16 includes a bow portion at the front of the watercraft, a control portion extending rearwardly therefrom, and a seating area positioned aft of the control portion. The bow portion slopes upwardly toward the control portion and includes an opening (not shown) for access to the inside of the watercraft hull 12. A hatch or lid 20, which covers the opening to inhibit an influx of water into the hull 12, also slopes upwardly to the control portion.

The control portion extends rearwardly from the bow portion and includes a display of meters (not shown) and a handlebar assembly 22. The handlebar 22 controls the steering of the watercraft 10 in a conventional manner. Although not illustrated, the handlebar assembly 22 also carries a variety of watercraft controls, such as, for example, a throttle control, a start switch and a lanyard switch.

The seating area comprises a seat base 25, foot areas 17, and an operator/passenger seat 24 detachably mounted to the seat base 25. The seat base 25 and the seat 24 extend longitudinally along the center of the watercraft. The foot areas 17 extend generally longitudinally and parallel to the sides of the seat base 25. A non-slip surface (not shown) is located in the foot areas 17 to provide increased grip and traction for the operator and the passengers.

The seat 24 may be straddled by an operator and by one, two or more passengers. The middle position of the operator on the seat 24 provides fore and aft balance when the operator rides alone. The seat 24 is desirably removable to provide access to an opening 27 (see FIG. 3) in the seat base 25 and into an engine compartment 26. The seat 24 is attached to the seat base 25 around the access opening 27 by a known latching mechanism (not shown).

The engine compartment 26 is formed in the hull 12 of the personal watercraft 10 to house an internal combustion engine 28 and other peripheral systems such as an air supply system, a fuel supply system, and an exhaust system. The engine 28 is desirably mounted in approximately a central position in the watercraft 10 and beneath the access opening 27 located on the upper deck section 16. A fuel tank 30 and one or more buoyant blocks (not shown) are located in a forward portion of the engine compartment 26 within the hull 12. The fuel tank 30 is mounted to a bottom surface 32 of the hull 12 using a plurality of fuel tank mounts (not shown). The buoyant block(s) affords additional buoyancy to the watercraft 10.

An air supply system ventilates the engine compartment 26 by supplying fresh air thereto. Such an air supply system desirably includes at least one air duct, and preferably at least two. For example as shown in FIG. 1, one air duct 34 is located toward a forward section of the engine compartment 26 while another air duct 36 is provided toward a rearward section of the engine compartment 26. Both ducts 34, 36 include an air inlet opening 38 at an upper end that extends into the upper deck section 16 and a lower outlet opening 40 that terminates above the bottom surface 32 of the engine compartment.

A plurality of engine mounts 42 secure the engine 28 to the lower surface 32 of the hull 12 and support the engine 28 within the engine compartment 26 of the watercraft 10. Each engine mount 42 advantageously comprises a pad constructed from rubber or a similar vibration dampening and isolating material. The engine mounts 42, with shock-absorbent pads, dampen engine vibrations, as well as reduce the impact felt by engine components as the hull 12 of the watercraft 10 bounces on the surface of the water in which the watercraft 10 is used, when in use.

Figure 2:
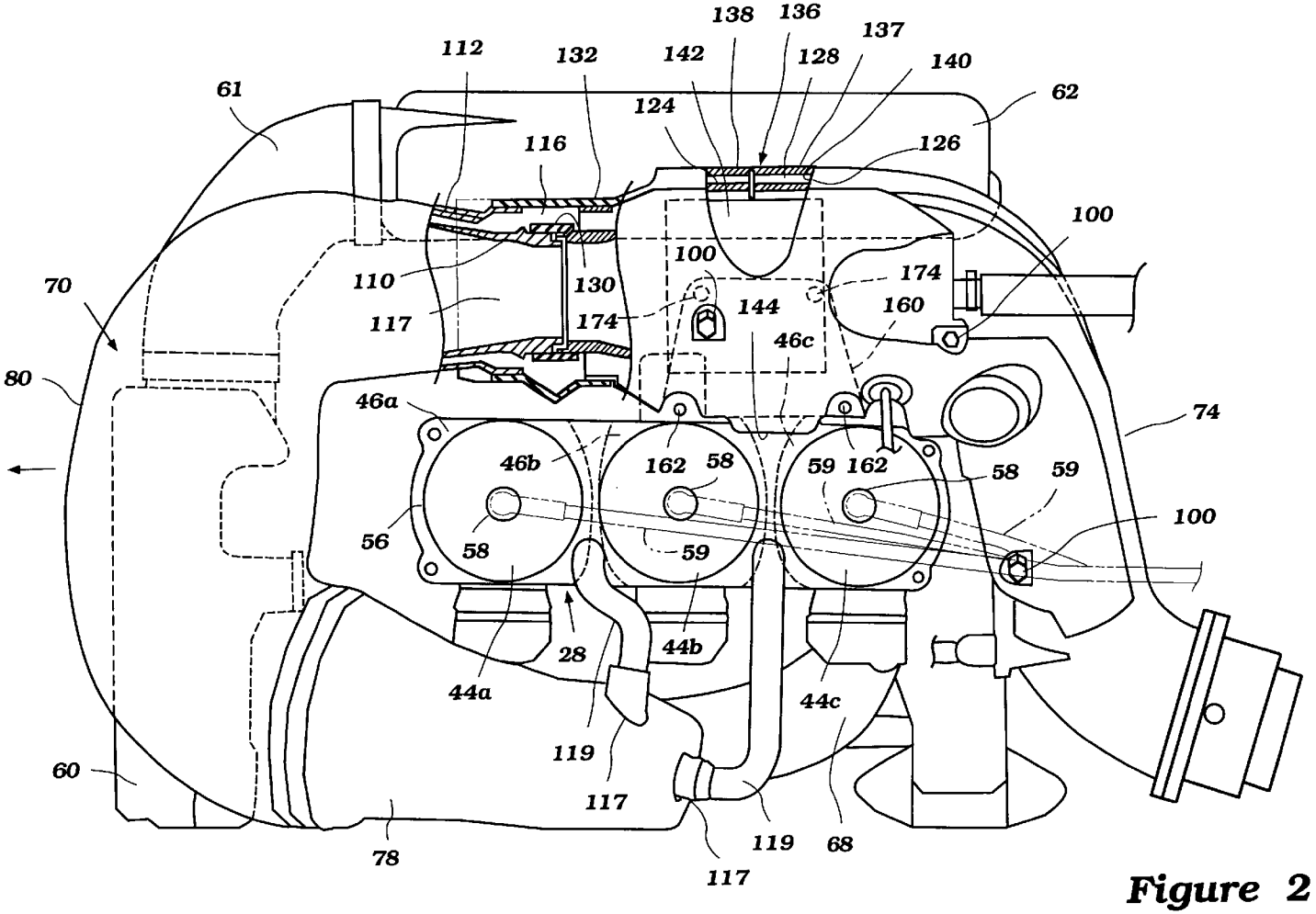
FIG. 2 is a partial top plan view of the engine and exhaust system of FIG. 1, with a portion of the exhaust system shown in section to reveal the interior thereof.
Figure 3:
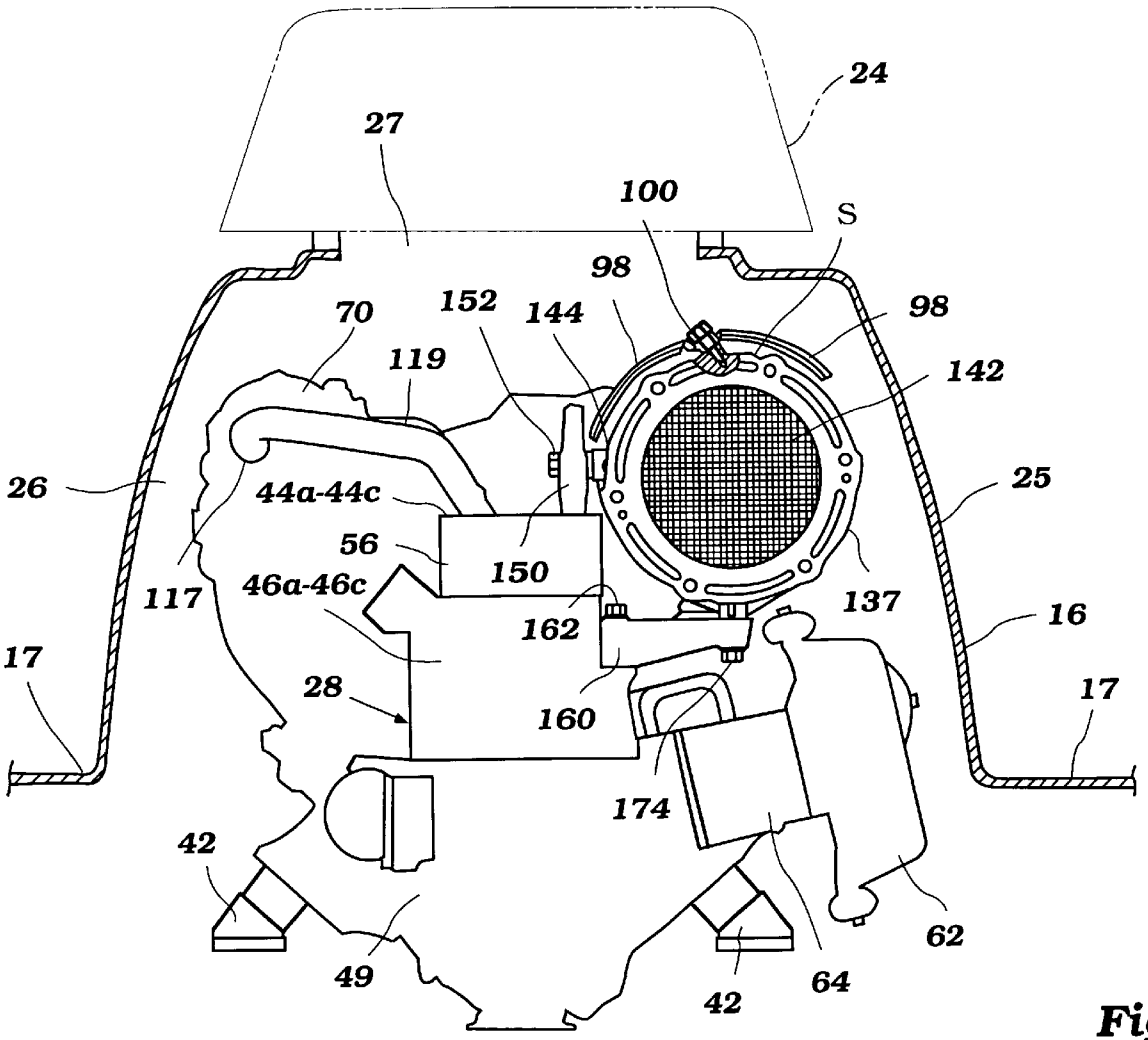
FIG. 3 is a partial sectional view of the engine and exhaust system taken at line 1—1 of FIG. 1 and illustrates the mounting arrangement of the exhaust system to the engine.

As best seen in FIGS. 2 and 3, the engine 28 in the illustrated embodiment includes three in-line cylinders 44*a–c* positioned substantially vertically and operates on a two-cycle, crankcase compressor principle. Other types of engines, which have other configurations (e.g., two cylinders, four cylinders and slanted) and operate on other principles (e.g., four cycle), can also be used with the present invention. The individual cylinders 44*a–c* are defined by separate cylinder bodies 46*a–c*. The cylinders 44*a–c* also lie parallel to a longitudinal axis 48 (see FIG. 1) of the watercraft 10, running bow to stern. While the engine 28 typically extends substantially longitudinally, it may also be arranged with an output shaft thereof oriented generally in a lateral or a vertical direction.

Pistons (not shown) are positioned within the bores of the cylinders 44*a–c*. A crankcase 49 (FIG. 3) is located beneath the cylinder bodies 46*a–c* and defines a plurality of crank chambers (not shown) underneath the cylinders. Connecting rods (not shown) connect the pistons to a crankshaft (not shown) that is housed and journalled within the crankcase.

On the upper end of the cylinder bodies 46*a–c,* a cylinder head 56 is provided. The cylinder head 56 includes a plurality of recesses (not shown) that correspond to each cylinder 44*a–c*. The recesses in the cylinder head 56, the cylinders 44*a–c* and the heads of the pistons together define a plurality of combustion chambers.

A spark plug 58 is mounted on top of each recess (not shown) of the cylinder head 56 and has its gap extending into the combustion chambers. The spark plugs 58 are fired by an ignition control unit that is controlled by an electronic control unit (not shown) of the engine 28. The spark plugs 58 are connected to the ignition control unit by spark plug leads 59. Preferably, the spark plugs are protected, at least partially, by the exhaust system that encircles the engine, as described further below.

FIG. 2 shows an air intake or induction system which supplies an air charge to the cylinders of the engine 28. Air is received through a first air intake box 60, which is located in front of the cylinders 44*a–c*. A connection hose 61 delivers the air to a second intake box 62, which is located to the side of the cylinders 44*a–c*. The second air intake box 62 communicates with a carburetor 64. The carburetor 64 communicates a plurality of air intake pipes (not shown), each of which houses a butterfly-type throttle valve (not shown) therewithin. A throttle trigger on the handle bars 22 controls the throttle valves to regulate the speed of the engine 28. Preferably, each cylinder is fed through a separate air intake pipe.

Although not illustrated, a fuel supply system of the engine 28 desirably includes a fuel pump, a fuel rail, a carburetor and interconnecting pipes therebetween. Fuel is transferred from the fuel tank 30 to the fuel pump, which supplies fuel to the fuel rail at a positive superatmospheric pressure. The fuel pump can be either mechanically or electrically driven. The fuel rail directs fuel into each fuel injector that is in communication with a combustion cylinder. The fuel system in the alternative can include one or more carburetors to form the fuel/air charge delivered to the engine.

As shown in FIG. 1, an exhaust system is provided to discharge exhaust gases from the engine 28 to the atmosphere and/or to the water. In general terms, the exhaust system includes an exhaust manifold 68, which is affixed to the side of the cylinder bodies 46*a–c,* and an expansion chamber 70, through which exhaust gases pass from the exhaust manifold 68. The expansion chamber 70, in turn, communicates with a water trap device 72 through a first exhaust pipe 74 whereby the outlet end of the expansion chamber adjoins the inlet end of the first exhaust pipe. The water trap device 72 inhibits the back flow of water into the first exhaust pipe 74. A second exhaust pipe 76 fluidly connects the water trap device 72 to a discharge opening 78. The second exhaust pipe 76 extends up and over a jet propulsion unit 80 located at the aft of the watercraft. The varied elevation of exhaust pipe 76 further inhibits the influx of water into the exhaust system. As shown in FIG. 2, the exhaust system preferably encircles and is positioned above, at least partially, the engine 28. In particular, it is preferred that the expansion chamber be positioned, at least partially, above the level of the cylinder head 56. By encircling the engine, the exhaust system affords some protection against water in the engine compartment inadvertently splashing against the spark plugs 58 during use of the watercraft. A more detailed description of the exhaust system follows below.

At the rear of the engine 28, a coupling 82 interconnects the engine output shaft (e.g., crankshaft) 50 to the jet propulsion unit 80. The output shaft rotates 50 about a generally longitudinal rotational axis. In the preferred embodiment, a portion of the first exhaust pipe 74 is positioned on one side of the rotational axis and at least a portion of the expansion chamber is positioned on the other side of the rotational axis.

The jet propulsion unit 80 comprises an impeller shaft 84 (shown in phantom) that drives an impeller 86. A bearing assembly (not shown), which is secured to a bulkhead or a front wall of a tunnel (not shown), supports the impeller shaft 84 behind the shaft coupling 82. In the illustrated embodiment, the jet propulsion unit 80 is positioned at the aft center of the lower hull section 14 and includes a gullet 88 having an inlet opening 90 formed on the bottom side of the lower hull section 14. The gullet 88 extends from the inlet opening 90 to a pressurization chamber 92 that, in turn, communicates with a nozzle section 94 of the propulsion unit 80. The pressurization chamber 92 is housed within a pump chamber 95, which is formed between the lower section 14 of the hull 12 and a bottom plate 91.

The impeller 86 of the jet propulsion unit 80 pressurizes the water within the pressurization chamber 92 and forces the pressurized water through the nozzle section 94 of the jet propulsion unit 80. A steering nozzle 96 controls the direction of the water stream exiting the jet propulsion unit 80. The steering nozzle 96 is pivotally supported at the rear of the jet propulsion unit 80 to change the thrust angle on the watercraft 10 for steering purposes, as is known in the art. The steering nozzle 96 is connected to the steering handlebar 22.

The impeller 86 is located toward the front end of the pressurization chamber 92. A central support (not shown) supports the rear end of the impeller shaft 84 behind the impeller 86 and generally at the center of the pressurization chamber 92. A bearing assembly (not shown) journals the rear end of the impeller shaft 84 within the support.

A water removal assembly (not shown) can be provided within the engine compartment 26. Desirably, the water removal assembly is a bilge system (not shown). The bilge system generally employs a conduit (not shown) which is in fluid communication with a portion of the nozzle section 94 of the jet propulsion unit 80. The conduit is connected to a bilge inlet or water pickup (not shown) provided in the engine compartment 26 adjacent to the engine 28 and near the bottom surface 32 of the lower hull section 14. Due to the high rate of water flow through the nozzle section 94, a venturi effect is created in the bilge system conduit, which draws water from the engine compartment through the conduit and into the nozzle section.

The bilge system, additionally or alternatively, can be equipped with a pump (not shown) that pumps water from the bilge region of the hull 12 to the conduit. The water is then forced through the conduit to an outlet (not shown) located near the stern of the watercraft 10. For example, the water may be expelled through an outlet located in a wall of the gullet 88.

With reference to FIG. 2, the exhaust system is described in further detail. With reference initially to FIG. 2, the exhaust manifold 68 comprises individual exhaust branch pipes, each of which extend outwardly from an exhaust port that communicates with the separate cylinders 44*a–c* to a merge portion of the manifold 68. The merge portion extends upward to an exhaust manifold outlet (not shown).

The outlet of the exhaust manifold 68 communicates with the expansion chamber 70, which includes an upstream section 78 and a C-shaped downstream section 80. The upstream section 78 is directly connected to the outlet of the exhaust manifold 68 and extends upward and forward (askew from the longitudinal direction 48) therefrom. The upstream section 78 connects to the C-shaped downstream section 80 of the expansion chamber 70 by way of a flanged connection. The upstream section 78 and the adjoining C-shaped downstream section 80 each have an end flange that are matably secured together with bolts. The C-shaped downstream section 90 extends at least in part forward of the front portion of the cylinders 44*a–c* and wraps around to extend rearward at a level above and opposite to the exhaust manifold 68. The expansion chamber 70 is also preferably positioned at a level higher than the cylinder head 56 of the engine 28.

The expansion chamber 70 includes an inner tube 110 and an outer tube 112, wherein the inner tube 110 forms an exhaust passage 114 for the exhaust gases. The outer tube 112 surrounds the inner tube 110 to form a coolant jacket 116 between the inner and outer tubes 110, 112. The coolant jacket 116 covers at least a portion, if not all, of the expansion chamber 70.

The upstream section 78 of the expansion chamber 70 forms a diffuser cone (not shown) that has an inner diameter that increases as it progresses downstream to join the C-shaped section 80. The inner tube 110 of C-shaped section 80 forms a convergent cone that has a maximum diameter at its inlet end and tapers decreasingly toward a downstream diameter. Although the present exhaust passage is described as having a generally circular cross-sectional shape, other cross-sectional flow area shapes are also possible.

The expansion chamber 70 includes water inlets 117 for the coolant jacket 116. The water inlets are connected by cooling hoses 119 to water jackets (not shown) formed in the cylinder head 56. The water jackets in the cylinder head 56 are in communication with the pressurization chamber 92 of the jet propulsion unit 80. Water can be received by the water jackets in the cylinder head 56 from the propulsion unit 80 either directly or indirectly via a cooling jacket formed in the exhaust manifold and/or the cylinder bodies 46*a–c* by known means.

As shown in FIG. 2, the first exhaust pipe 74 is connected to the outlet of the C-shaped downstream section 80 of the expansion chamber 70. The first exhaust pipe 74 extends rearward at generally the same elevational level as the expansion chamber 70 for approximately the length of the engine, and then downward past the rear end of the cylinders 46*a–c*. The outlet end of the first exhaust pipe 74 connects to the water trap device 72 (not shown), as discussed above in connection with FIG. 1. Like the expansion chamber 70, the first exhaust pipe 74 also has a dual shell construction formed by an inner tube 124 and an outer tube 126 that surrounds the inner tube 124. The inner tube 124 defines an exhaust flow passage therethrough while the space between the inner tube 124 and the outer tube 126 forms a coolant jacket 128 covering at least a portion, if not all, of the exhaust pipe 74. The coolant jackets 116, 128 surrounding the expansion chamber 70 and first exhaust pipe 74, respectively, are in fluid communication with each other. In the illustrated embodiment, the cooling jacket 128 completely surrounds the exhaust flow passage; however, it need not in all applications. Those skilled in the art would be readily able to configure the cooling jacket to suit a particular application.

As shown in FIG. 2 specifically, flexible couplings 130, 132 connect the inner and outer tubes 110, 112 at the outlet of the C-pipe section 80 to the inner and outer tubes 124, 126 at the inlet end of the first exhaust pipe 74. The flexible couplings 130, 132 are advantageously made of a heat insulating material to avoid heat transfer between the inner and outer tubes 110, 112, 124, 126. A pair of binding bands (not shown) seals outer coupling 132 to prevent leaks between the expansion chamber 70 and the exhaust pipe 74.

As shown in FIG. 2, the diameter of the inner tube 124 at the inlet of the first exhaust pipe 74 increases significantly to form a catalyzer assembly downstream of the inlet. The catalyzer assembly comprises a catalyzer housing 136 defining a catalyst chamber 137. Downstream of the catalyst chamber 137, the first exhaust pipe 74 returns to a diameter of approximately the same diameter as the inlet. In the preferred embodiment, the catalyzer housing 136 has an enlarged diameter relative to the outlet end of the expansion chamber 70, as indicated above, although a catalyzer housing having a diameter the same as or less than the outlet of the expansion chamber is also possible. The catalyst chamber 137 is located proximate the outlet of the expansion chamber 70 and preferably closer to the expansion chamber 70 than to the water trap device 72. It is also preferable that the catalyst chamber 137 be positioned, at least partially, forward of the rear end of the engine and above the cylinder head 56, as shown in FIGS. 2–5. The enlarged catalyzer housing 136 of the first exhaust pipe 74 has upstream and downstream housing sections 138, 140 joined at approximately the center of the catalyst chamber 137.

As shown in FIG. 3, the catalyzer assembly further comprises a catalyst 142 housed within the catalyst chamber 137 of the first exhaust pipe 74 (not shown). The catalyst preferably includes an annular shell supporting a honeycomb-type catalyst bed. The catalyst bed is formed of a suitable catalytic material, such as that designed to treat and render harmless hydrocarbons, carbon monoxide, and oxides of nitrogen. Because catalytic materials used in engines generally require extreme heat to be effective, the catalyst chamber is preferably located close to the expansion chamber 70, in which the temperature of the exhaust gases is higher than that in the first exhaust pipe 74.

With reference back to FIG. 2, interposed between the upstream and downstream housing sections 138, 140 of the first exhaust pipe 74, the catalyzer assembly further comprises an annular flange (not shown) provided around the annular shell to secure and support the catalyst 142 with the enlarged catalyzer housing 136. A plurality of holes (not shown) is formed through the flange to permit the passage of water from coolant jacket 116 to coolant jacket 128 (or vice versa). Locating the annular flange between the upstream housing section 138 and the downstream housing section 140 facilitates the removal and exchange of catalyst 142 by disconnecting the upstream and downstream housing sections 138, 140.

A lower wall (not shown) of the concentrically tapered enlarged catalyzer housing 136, upstream of the catalyst 142, provides a gravitational barrier to any water that may inadvertently back flow into the catalyst chamber 137 from entering the expansion chamber 70. This sloping lower wall also inhibits the passage of any catalytic materials (that may drop from the catalyzer bed) back up into the expansion chamber 70, so as to maintain the full catalytic power of the catalyst 142.

Advantageously, the inner tube 124 of the first exhaust pipe 74, downstream from the catalyst 142, tapers eccentrically in such a way that the lower surface is relatively level so as to prevent the collection of water within the catalyst chamber 137 that may inadvertently backwash thereinto. In, contrast, the upper surface is substantially inclined and has a greater degree of incline than the lower surface with respect to the axis of flow through the catalyst chamber. Thus, under normal operating conditions, this lower surface is orientated either substantially horizontally, when the watercraft is at rest or moving slowly through calm waters, or inclined downwardly away from the catalyst chamber 137 when the watercraft is in motion with the bow projecting upward; i.e., up on plane. Any water that inadvertently back flows into the catalyst chamber 137 would, by gravity, wash immediately away from the catalyst 142 down the sloping downstream end of the first exhaust pipe 74. It is extremely important that as little water as possible, preferably no water, come into contact with the catalyst 142. Because it is maintained at such a high temperature, on the order of magnitude of approximately 1400° F., the catalyst would fracture upon contact with the much cooler water. It is preferred that the catalyst 142 be positioned at least partially above the elevation of the cylinder head 56, as shown in FIG. 3.

As also indicated by FIG. 3, the catalyst chamber 137 is preferably shielded by an insulting shield 98. The shield 98 consists of a heatproof resin material and a sound absorbing material. The shield is attached to the catalyst chamber 137 heat by a bolt 100 that is screwed into a hole formed in the body of the catalyst chamber 137. As shown in FIG. 3, the shield 98 is separated from the catalyst chamber by a space S, which serves as an additional heat insulating layer. Accordingly, the shield 98 prevents the catalyst chamber 137 from causing damage to other engine parts and dampens noise emanating from the exhaust system.

A water mixing portion (not shown) is provided in the first exhaust pipe 74 adjacent the water trap device 72, which is at a level lower than the catalyst chamber 137 in which the catalyst 142 is located. The water mixing portion comprises a hole (not shown) formed in the inner tube 124 of the first exhaust pipe 74 that permits water flowing through the coolant jacket to be injected into the interior of the first exhaust pipe. The injection of water through the hole reduces exhaust thundering noise.

Other configurations of the water mixing portion are contemplated. For example, in an another embodiment, the coolant jacket around the exhaust pipe 74 terminates at a distance from the water trap device 72. A water line, with a spray nozzle at the end, is sealably positioned in the wall of the exhaust pipe 74 between the coolant jacket and the water trap device 72 so as to forcibly inject water into the exhaust system. In another embodiment of the water mixing portion, the inner tube 124 terminates upstream from the termination of the outer tube 126 so that the water flowing through the coolant jacket empties circumferentially from the coolant jacket into the interior of the exhaust pipe 74. In still another embodiment, the inner tube terminates downstream of the outer tube 126 wherein the inner tube has one or more holes proximate to and upstream from the termination of the outer tube to permit the discharge of the coolant water into the exhaust pipe 74. It is contemplated that the water supply for the water mixing portion comes either from the same cooling system that feeds the coolant jacket or a separate independent cooling system.

Advantageously, because the catalyst 142 is housed within the catalyst chamber 137 of the first exhaust pipe 74, rather than within the expansion chamber 70, engine performance is enhanced. That is, the expansion chamber serves to enhance engine performance by having a convergent cone section and a diffuser cone section that together generate return pressure waves in the exhaust gases passing through the expansion chamber. Those return shock waves act to regulate the exhaust gases expelled from the combustion cylinders, which increases efficiency in the combustion cycle. By eliminating the catalyst from the expansion chamber, formation of the return pressure waves may take place without interference.

Furthermore, because the catalyst chamber 137 is located preferably close to the expansion chamber 70, the catalysts are more easily activated by the relatively hot exhaust gases, even immediately after the start-up of the engine 28.

Insulating materials used in the couplings 130, 132, and the insulating shield 154, block the heat transfer from the first exhaust pipe 74 and prevent overheating of the engine 28. The tapered structures at both sides of the enlarged catalyzer housing 136 maintain the catalytic power of the catalyst 142 by avoiding water staying within the catalyst chamber 137. Further, since the water mixing portion is located in a lower level than the catalyst chamber 137, water introduced into the exhaust gas passage in the portion does not reach the catalyst 142 disposed within the catalyst chamber 137.

An inventive mount for attaching an engine component to the engine, which is configured in accordance with a preferred embodiment, will now be described in detail. As best seen in FIG. 3, a first stay 150 extends generally upright from the top of the cylinder head 56. The first stay 150 is preferably integrally formed into the body of the cylinder head 56 (e.g., formed within the same cast or unitary piece). Alternatively, the first stay 150 can be separately attached to the cylinder head by welds or fasteners (e.g., bolts). The first stay 150 has been removed from FIG. 2 to improve the clarity of the Figure.

The first stay 150 desirably supports an engine component. The first stay 150 is particularly useful in supporting heavy engine components such as the catalyst chamber 137. Accordingly, in the present configuration, the first stay 150 is arranged to support the catalyst chamber 137. As such, the first stay 150 is preferably located between two adjacent cylinders at the rear of the cylinder back such that the face of the stay 150 faces the center of the catalyst chamber 137.

As shown in FIGS. 2 and 3, the catalyst chamber 137 includes a boss 144 in which one or more threaded holes (not shown) are formed. As shown in FIG. 2, the boss 144 extends towards the cylinder head 56. One or more bolts 152 extend through holes (not shown) in the first stay 150 and into the one or more holes formed in the boss 144. Accordingly, the catalyst chamber 137 is rigidly attached to the cylinder head 56. This rigid connection reduces the vibration of the catalyst chamber 137 and provides vertical and lateral support for the catalyst chamber 137.

As shown in FIGS. 2, 3, 4 and 5, a second stay 160 is advantageously provided to support an engine component. Preferably, the second stay 160 supports a portion of the exhaust system. More preferably, as in the illustrated arrangement, the second stay 160 supports the catalyst chamber 137 and a portion of the first exhaust pipe 74.

Figure 5:
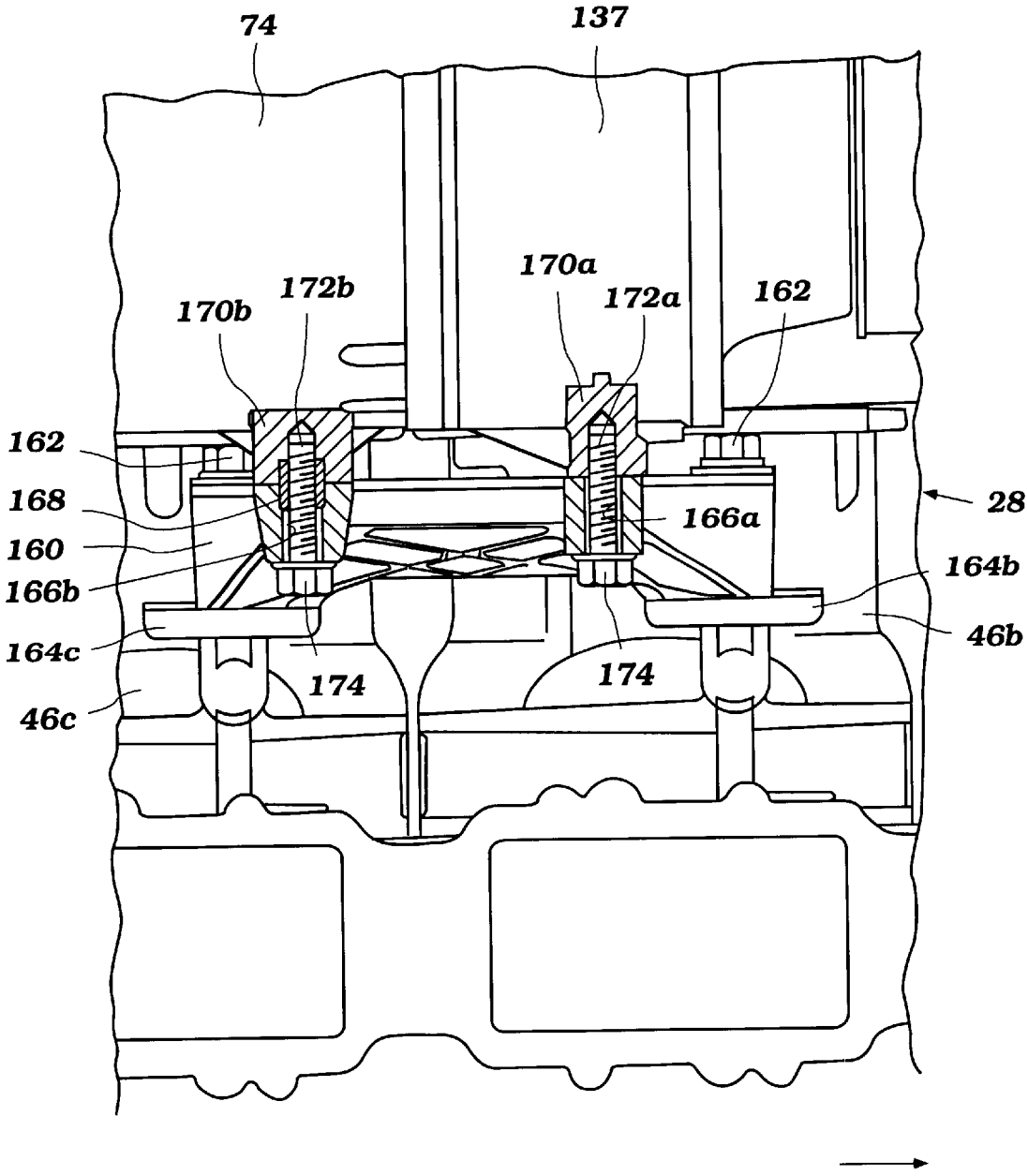
FIG. 5 is a partial side sectional view of the stay shown in FIG. 4 and illustrate the connection between the stay and a portion of the exhaust system.

As best seen in FIG. 5, brackets 164*b*, 164*c* are integrally formed within the side of two or more cylinder bodies. Alternatively, the brackets could be separately attached to the cylinder body by welds or fasteners. Preferably, the brackets 164*b*, 164*c* are located on the sides of two adjacent cylinder bodies. When supporting a catalyst chamber as in the current arrangement, the brackets 164*b*, 164*c* are preferably located on two adjacent cylinder bodies that are situated at the rear of the cylinder bank such that the brackets 164*b*, 164*c* lie generally beneath the catalyst chamber 137. Furthermore, as best seen in FIG. 2, the brackets 164*b*, 164*c* are preferably situated above the carburetors 64 and below the cylinder head 56.

Figure 4:
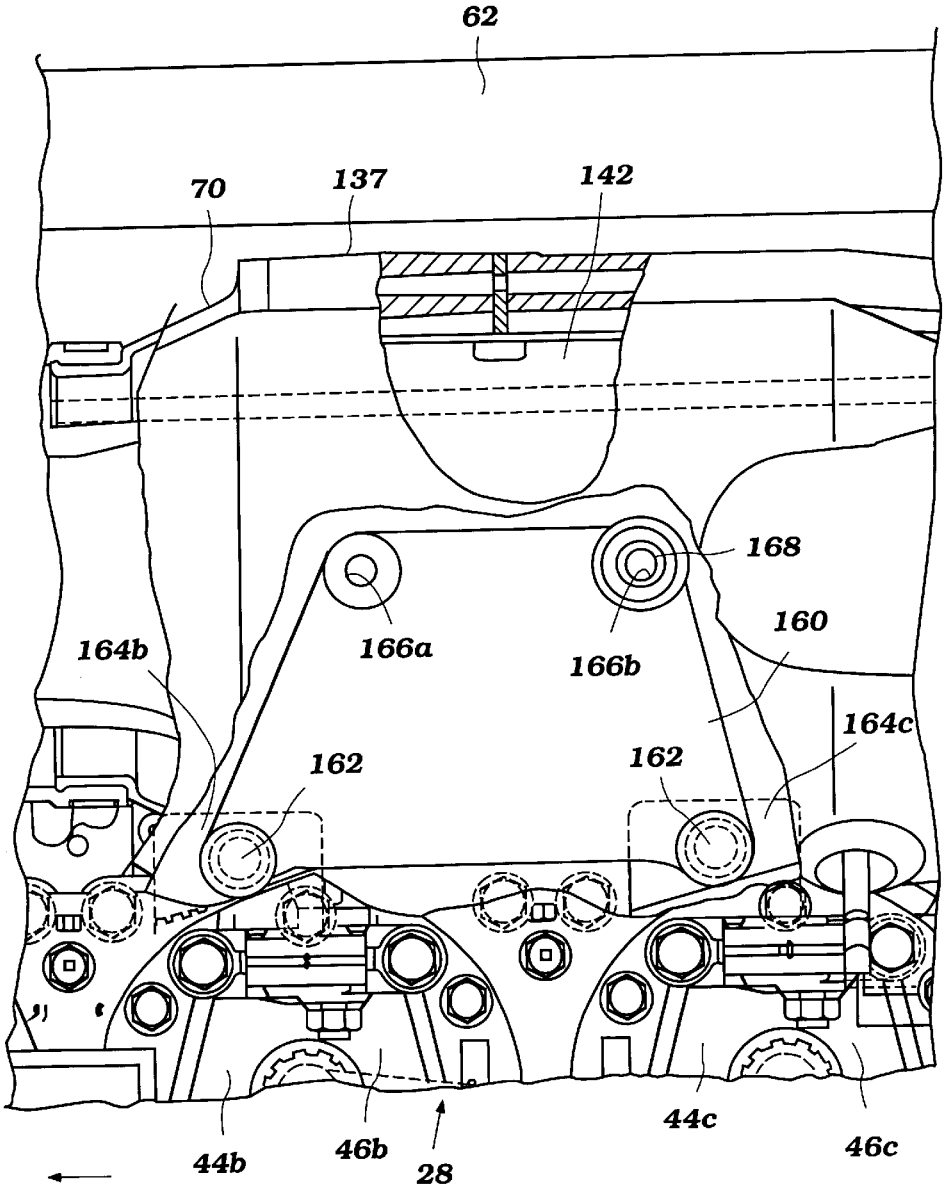
FIG. 4 is an enlarged view of a stay shown in dashed lines in FIG. 1 with part of the exhaust system cut away to expose the stay.

The brackets 164*b*, 164*c* provide a substantially flat horizontal surfaces that support the second stay 160. The second stay 160 is preferably attached to the brackets 164*b*, 165*c* by fasteners (e.g., bolts 162). As best seen in FIGS. 4 and 5, the second stay 160 in the illustrated embodiment is substantially square and flat. In particular, the stay 160 extends longitudinally across the two cylinder bodies 46*b*, 46*c* and horizontally outward from the cylinder bodies. The stay 160 tapers down to a smaller width as it extends outward from the cylinder bodies, as best seen in FIG. 5. The second stay 160 is also preferably webbed so as to reduce weight. As shown in FIG. 2, the second stay 160 preferably exists in a space between the cylinder bodies 46*b*, 46*c*, and the second intake box 62. Of course, the second stay can take other shapes to suit other particular applications, as readily understood by one skilled in the art.

Bolt holes 166*a*, 166*b* are provided at the tapered end of the second stay 160 opposite the cylinder bodies 46*b*, 46*c*. Brackets 170*a*, 170*b*, are preferably provided on the first exhaust pipe and 74 catalyst chamber 137. The brackets 170*a*, 170*b* are preferably integrally formed into the catalyst chamber, but they may be alternatively separately attached to the chamber 137 by, for example, welds or fasteners.

The brackets 170*a*, 170*b* are situated substantially above the bolt holes 166*a*, 166*b*. As seen in FIG. 5, each bracket 170*a*, 170*b* has a bolt hole 172*a*, 172*b* formed to received bolts 174 that couple the second stay 160 to the brackets 170*a*, 170*b*. Preferably, one bracket 170*b* is situated on upstream section housing section 138 of the catalyst chamber 137 while the other bracket 170*a* is mounted to the downstream section 140 of the catalyst chamber 137. A collar 168 is preferably inserted into one of the bolt holes 166*b* so as to aid in centering the bracket 170*b* on the second stay 160 and aligning an axis of the catalyst chamber 137 at a desired location along the side of the engine 28.

The first and second stays 150, 160 described above rigidly attach and support an engine component to more than one cylinder body. In the illustrated embodiment, the first and second stays support a particularly heavy engine component, the catalyst chamber 137. Because the second stay 150 is attached to two cylinder bodies 44*b*, 44*c*, the weight of the catalyst chamber 137 is advantageously divided between two cylinders bodies 44*b*, 44*c*. In comparison, if the catalyst chamber 137 were supported by one cylinder body, the weight of the catalyst chamber 137 would unevenly load the cylinder causing it to be twisted with respect to the other cylinders and the crankshaft of the engine 28.

Although this invention has been described in terms of a certain preferred embodiment, other embodiments apparent to those of ordinary skill in the art are also within the scope of this invention. Accordingly, the scope of the invention is intended to be defined only by the claims that follow.

What is claimed is:

1. A small watercraft comprising hull including an engine compartment, an internal combustion engine disposed within the engine compartment and including an output shaft that drives a propulsion unit of the watercraft, an exhaust system of the engine arranged within the hull to discharge exhaust gases, the engine including at least two separate cylinder bodies arranged adjacent to each other, each cylinder body supporting a piston that reciprocates within the cylinder body and is coupled to the output shaft of the engine, and a stay being supported by and extending between the two adjacent cylinder bodies, the stay being arranged to support a component of the engine.

2. A small watercraft as in claim 1, wherein cylinder axes of the two adjacent cylinder bodies lie generally parallel to each other.

3. A small watercraft as in claim 1, wherein the component of the engine that is supported by the stay is a portion of the exhaust system.

4. A small watercraft as in claim 3, wherein the portion of the exhaust system that is supported by the stay is an exhaust chamber that houses a catalyst device.

5. A small watercraft as in claim 4, wherein the exhaust chamber is formed by an upstream section and a downstream section, and the stay is situated between the upstream and downstream sections and is independently coupled to each of the upstream and downstream sections.

6. A small watercraft as in claim 1, wherein the engine additionally comprises an air induction system that includes a plurality of intake conduits each of which communicates with one of the cylinders, and the stay is located in a space between the intake conduits and the separate cylinder bodies.

7. A small watercraft as in claim 6, wherein the engine additionally includes a plurality of charge formers each of which communicates with one of the intake conduits, and the stay is located in a space above the charge formers that correspond to the two adjacent cylinder bodies.

8. A small watercraft as in claim 1, wherein the engine additionally comprises a cylinder head and a second stay extending from the cylinder head, and the engine component is additionally supported by the second stay.

9. A small watercraft as in claim 8, wherein the second stay extends generally upright from the cylinder head.

10. A small watercraft as in claim 8, wherein the second stay extends from the cylinder head in a direction that is substantially perpendicular to a direction in which the first stay extends from the cylinder bodies.

11. A small watercraft as in claim 1, wherein each cylinder body includes a bore plated with a layer of material.

12. An engine for a small watercraft comprising at least two separate cylinder bodies, the cylinder bodies disposed adjacent to each other, each cylinder body defining a cylinder bore, a plurality of pistons corresponding to the number of cylinder bodies, each piston sliceable supported within one of the cylinder bores, a rotational output shaft being coupled to the pistons such that axial reciprocal movement of the pistons within the cylinder bores rotates the output shaft, an exhaust system communicating with the cylinder bores to discharge exhaust gases from the engine, and a stay being supported by and extending between the two adjacent cylinder bodies, the stay being arranged to support a component of the engine.

13. An engine as in claim 12, wherein cylinder axes of the two adjacent cylinder bodies lie generally parallel to each other.

14. An engine as in claim 12, wherein the component of the engine that is supported by the stay is a portion of the exhaust system.

15. An engine as in claim 14, wherein the portion of the exhaust system that is supported by the stay is an exhaust chamber that houses a catalyst device.

16. An engine as in claim 12, wherein the engine additionally comprises a cylinder head and a second stay extending from the cylinder head, and the engine component is additionally supported by the second stay.

17. An engine as in claim 16, wherein the second stay extends generally upright from the cylinder head.

18. An engine as in claim 17, wherein the second stay extends from the cylinder head in a direction that is substantially perpendicular to a direction in which the first stay extends from the cylinder bodies.

19. An engine as in claim 12, wherein each cylinder bore is plated with a layer of material.

20. An engine for a small watercraft comprising at least two separate cylinder bodies, the cylinder bodies disposed adjacent to each other, each cylinder body defining a cylinder bore, a plurality of pistons corresponding to the number of cylinder bodies, each piston sliceable supported within one of the cylinder bores, a rotational output shaft being coupled to the pistons such that axial reciprocal movement of the pistons within the cylinder bores rotates the output shaft, an exhaust system communicating with the cylinder bores to discharge exhaust gases from the engine, and support means for mounting an engine component to the two adjacent cylinder bodies.

21. An engine as in claim 20, wherein cylinder axes of the two adjacent cylinder bodies lie generally parallel to each other.

22. An engine as in claim 20, wherein the component of the engine that is supported by the support means is a portion of the exhaust system.

23. An engine as in claim 22, wherein the portion of the exhaust system that is supported by the support means is an exhaust chamber that houses a catalyst device.

24. An engine as in claim 23, wherein the engine additionally comprises an air induction system that includes a plurality of intake conduits each of which communicates with one of the cylinder bores, and the support means is located in a space between the intake conduits and the separate cylinder bodies.

25. An engine as in claim 24, wherein the engine additionally includes a plurality of charge formers each of which communicates with one of the intake conduits, and the support means is located in a space above the charge formers that correspond to the two adjacent cylinder bodies.

* * * * *

UNITED STATES PATENT AND TRADEMARK OFFICE

CERTIFICATE OF CORRECTION

PATENT NO. : 6,253,696 B1
DATED : July 3, 2001
INVENTOR(S) : Mashiko

It is certified that error appears in the above-identified patent and that said Letters Patent is hereby corrected as shown below:

Column 2,
Line 4, change “sliceable” to -- slidably --.

Column 12,
Lines 11 and 45, change “sliceable” to -- slidably --.

Signed and Sealed this

Third Day of August, 2004

JON W. DUDAS
*Acting Director of the United States Patent and Trademark Office*